US005253019A

United States Patent [19]

Brewington et al.

[11] Patent Number: 5,253,019

[45] Date of Patent: Oct. 12, 1993

[54] DEVELOPER MATERIAL TRANSPORT

[75] Inventors: Grace T. Brewington, Fairport; William H. Wayman, Ontario, both of N.Y.

[73] Assignee: Xerox Corporation, Stamford, Conn.

[21] Appl. No.: 428,726

[22] Filed: Oct. 30, 1989

[51] Int. Cl.[5] ..... G03G 15/06

[52] U.S. Cl. ..... 355/259; 118/661; 222/DIG. 1; 355/260

[58] Field of Search ..... 355/259, 260, 245; 222/DIG. 1; 118/644, 661, 653

[56] References Cited

U.S. PATENT DOCUMENTS

| | | | |
|---|---|---|---|
| 3,900,002 | 8/1975 | Stange | 118/637 |
| 4,493,550 | 1/1985 | Takekida | 355/256 |
| 4,615,606 | 10/1986 | Nishikawa | 222/DIG. 1 |
| 4,641,602 | 2/1987 | Kasai | 118/653 |
| 4,696,255 | 9/1987 | Yano et al. | 118/653 |
| 4,743,936 | 5/1988 | Bares | 222/DIG. 1 |
| 4,743,937 | 5/1988 | Martin | 355/259 |
| 4,760,422 | 7/1988 | Seimiya | 118/653 X |
| 4,774,541 | 9/1988 | Martin et al. | 355/259 |
| 4,777,904 | 10/1988 | Gundlach et al. | 118/653 |
| 4,788,570 | 11/1988 | Ogata et al. | 355/245 |
| 4,794,878 | 1/1989 | Connors et al. | 118/653 |
| 4,806,992 | 2/1989 | Yasuda et al. | 355/259 |
| 4,819,027 | 4/1989 | Murasaki et al. | 222/DIG. 1 |
| 4,926,217 | 5/1990 | Bares | 355/253 |
| 4,972,230 | 11/1990 | Wayman | 355/246 |
| 5,012,297 | 4/1991 | Knapp | 355/253 |

FOREIGN PATENT DOCUMENTS

| | | | |
|---|---|---|---|
| 3434434 | 4/1985 | Fed. Rep. of Germany | 355/259 |
| 0240261 | 10/1986 | Japan | 355/245 |
| 0028775 | 2/1987 | Japan | 355/245 |
| 0200376 | 9/1987 | Japan | 355/259 |
| 0257185 | 11/1987 | Japan | 355/245 |
| 0273888 | 11/1988 | Japan | 355/259 |

OTHER PUBLICATIONS

Toner Dispenser, vol. 17 No. 4 Sep. 1974, R. A. Daniels IBM Technical Disc. Bulletin.

*Primary Examiner*—A. T. Grimley
*Assistant Examiner*—Matthew S. Smith
*Attorney, Agent, or Firm*—H. Fleischer; J. E. Beck; R. Zibelli

[57] ABSTRACT

An apparatus which develops a latent image recorded on an image receiving member with developer material. A chamber in the developer housing stores a supply of developer material. A donor roll is positioned in the chamber of the housing so as to transport developer material into contact with the latent image to develop the latent image. A rotating, elongated member fluidizes the developer material. As developer material is discharged from a storage container into the chamber of the developer housing, it exerts pressure on the fluidized developer material to move the developer material from one end of the housing to the other end thereof. An electrical bias is applied between the elongated member and the donor roll so that developer material is attracted to the donor roll as the developer material advances from one end of the developer housing to the other end thereof.

4 Claims, 3 Drawing Sheets

DEVELOPER MATERIAL TRANSPORT

This invention relates generally to an electrophotographic printing machine, and more particularly concerns a development apparatus in which developer material is fluidized and moved from one end of a developer housing to the other end thereof while being attracted to a donor roll.

In an electrophotographic printing machine, a photoconductive member is charged to a substantially uniform potential to sensitize the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational areas contained within the original document being reproduced. After the electrostatic latent image is recorded on the photoconductive member, the latent image is developed by bringing a developer material into contact therewith. This forms a powder image on the photoconductive member which is subsequently transferred to a copy sheet. The copy sheet is heated to permanently affix the marking particles thereto in image configuration.

In the foregoing type of printing machine, a development system is employed to deposit developer material onto the electrostatic latent image recorded on the photoconductive surface. Generally, the developer material comprises toner particles adhering triboelectrically to coarser carrier granules. Typically, the toner particles are made from a thermoplastic material while the carrier granules are made from a ferromagnetic material. Alternatively, a single component material may be employed. However, a large continuous supply of toner particles must be available to be capable of copying large numbers of original documents or producing multiple copies of the same original document. This is necessary in order to insure that the machine is not shut down at relatively short intervals due to the lack of toner particles. This is achieved by storing a supply of toner particles in a toner container and dispensing additional toner particles into one end of the developer housing chamber. The toner particles are then transported across the chamber of the developer housing and advanced to a developer roller. The developer roller transports the toner particles closely adjacent to the photoconductive member and the latent image attracts toner particles thereto. However, it has been found that it is frequently difficult to load the developer roller with a sufficient quantity of developer material uniformly along the length thereof. This has resulted in image defects which degrade the quality of the copy. Various approaches have been devised to solve this problem, the following disclosure appears to be relevant:

Co-pending U.S. patent application Ser. No. 06/895,543, Applicant: Bares, Filed: Aug. 11, 1986. U.S. Pat. No. 3,900,002, Patentee: Stange, Issued: Aug. 19, 1975. U.S. Pat. No. 4,493,550, Patentee: Takekida, Issued: Jun. 15, 1985. U.S. Pat. No. 4,774,541, Patentee: Martin et al., Issued: Sep. 27, 1988. U.S. Pat. No. 4,794,878, Patentee: Connors et al., Issued: Jan. 3, 1989.

IBM Technical Disclosure Bulletin, Volume 17, No. 4, Page No. 1094, Author; Daniels, Published: September 1974.

The relevant portions of the foregoing patent application may be briefly summarized as follows:

Co-pending U.S. patent application Ser. No. 06/895,543 discloses an apparatus that moves marking particles from a storage container through a duct to a developer unit. The apparatus includes an elongated member disposed interiorly of the duct. The elongated member is moved to fluidize the marking particles in the duct without inducing substantial linear movement of the marking particles along the duct. A pressure differential is generated to move the fluidized particles along the duct from one end of the duct to the other end of the duct. In this way, the marking particles advance from the storage container to the developer unit.

U.S. Pat. No. 3,900,002 discloses a developing system in which a fur brush receives marking particles from a donor assembly. The donor assembly is made from a pair of hemispherical members to define a tube having a slot therein. The donor assembly is coated with an insulating material to assist in triboelectrically attracting particles from the sump.

U.S. Pat. No. 4,493,550 describes a cylindrical sleeve having depressions in the outer surface for holding ink therein. The sleeve is rotated in a tank holding ink. The sleeve is electrically biased to attract electrically conductive ink. The ink is picked up in the depressions and advanced to a drum having a latent image recorded thereon.

U.S. Pat. No. 4,774,541 discloses a plurality of spaced wires arranged in a cylindrical envelope to define a squirrel cage which delivers charged toner particles to a donor roller.

U.S. Pat. No. 4,794,878 describes a single component development system having an ultrasonic transducer which moves charged toner from a sump of a developer housing to a latent image recorded on a photoreceptor.

The IBM Technical Disclosure Bulletin discloses a toner container having an open end with a flexible spline disposed thereat. The spline seals the container. As the spline rotates, toner is metered from the container.

Pursuant to the features of the present invention, there is provided an apparatus for developing a latent image recorded on an image receiving member. The apparatus includes a housing defining a chamber storing a supply of developer material therein. Means, disposed at least partially in the chamber of the housing, transport developer material into contact with the latent image recorded on the image receiving member. Means, disposed in the chamber of the housing, fluidize the developer material. Means discharge additional developer material into the chamber of the housing with the developer material being discharged into the chamber exerting a pressure on the fluidized developer material to move the fluidized developer material from one end of the housing to the other end thereof. Means apply an electrical bias between the fluidizing means and the transporting means so that fluidized developer material is attracted to the transporting means.

In accordance with another aspect of the present invention, there is provided an electrophotographic printing machine of the type having an electrostatic latent image recorded on a photoconductive member. The improvement includes a housing defining a chamber storing a supply of developer material therein. Means, disposed at least partially in the chamber of the housing, transport developer material into contact with the latent image recorded on the image receiving member. Means, disposed in the chamber of the housing, fluidize the developer material. Means discharge additional developer material into the chamber of the housing with the developer material being discharged into the chamber exerting a pressure on the fluidized developer material to move the fluidized developer material from one end of the housing to the other end thereof. Means apply an electrical bias between the fluidizing means and the transporting means so that fluidized developer material is attracted to the transporting means.

Other aspects of the present invention will become apparent as the following description proceeds and upon reference to the drawings, in which.

Figure 2:
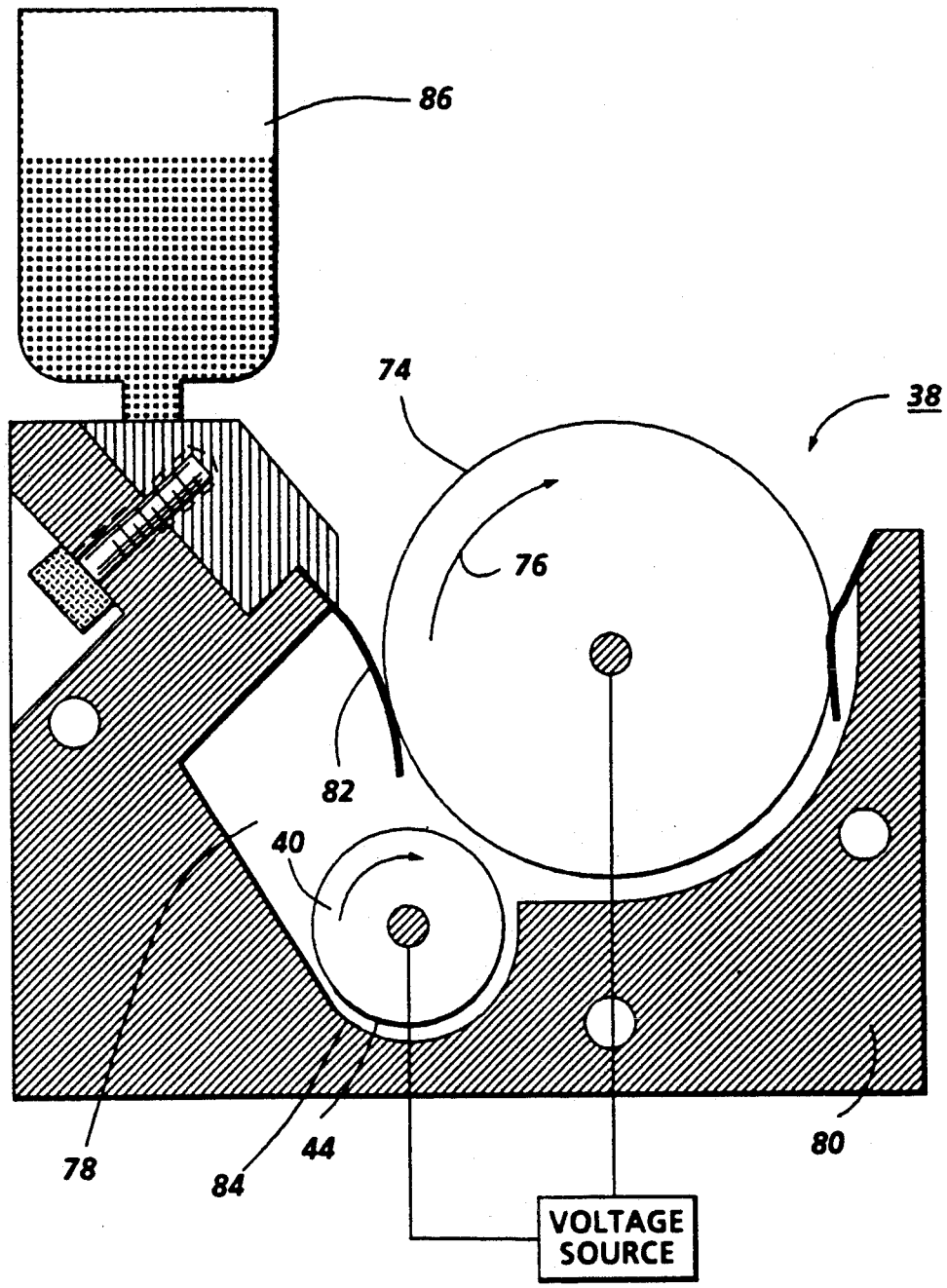
FIG. 2 is a schematic elevational view showing the development apparatus used in the FIG. 1 printing machine.
Figure 3A:
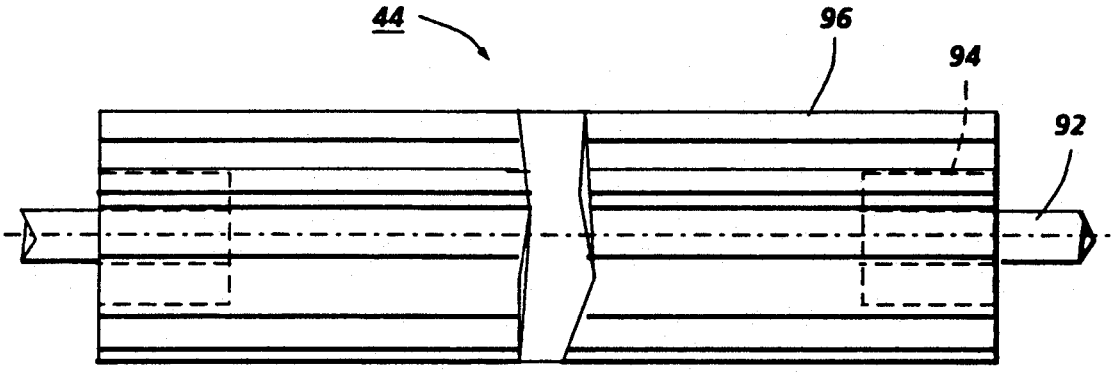
Figure 3B:
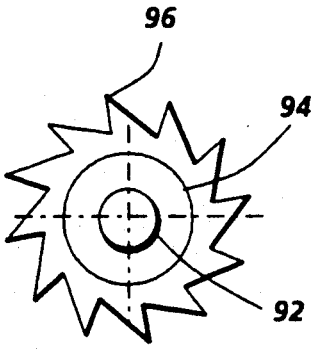
Figure 4B:
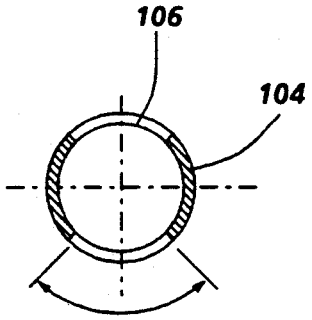
Figure 4A:
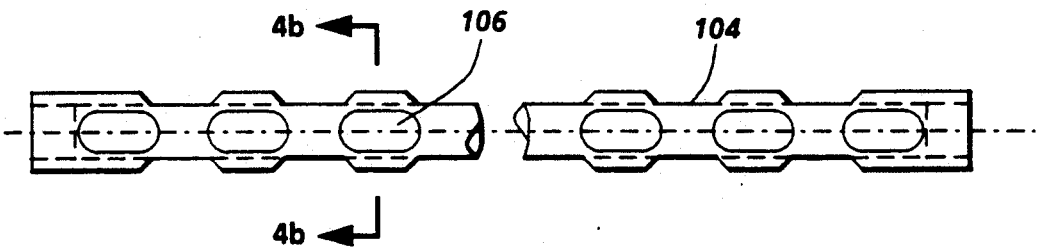

FIG. 3*a* is an elevational view depicting one embodiment of an elongated member used to fluidize the developer material in the FIG. 2 development apparatus;

FIG. 3*b* is a side elevational view of the FIG. 3*a* elongated member;

FIG. 4*a* is an elevational view depicting another embodiment of an elongated member used to fluidize the developer material in the FIG. 2 development apparatus; and FIG. 4*b* is a side elevational view of the FIG. 4*a* elongated member.

While the present invention will hereinafter be described in connection with various embodiments thereof, it will be understood that it is not intended to limit the invention to these embodiments. On the contrary, it is intended to cover all alternatives, modifications and equivalents that may be included within the spirit and scope of the invention as defined by the appended claims.

Figure 1:
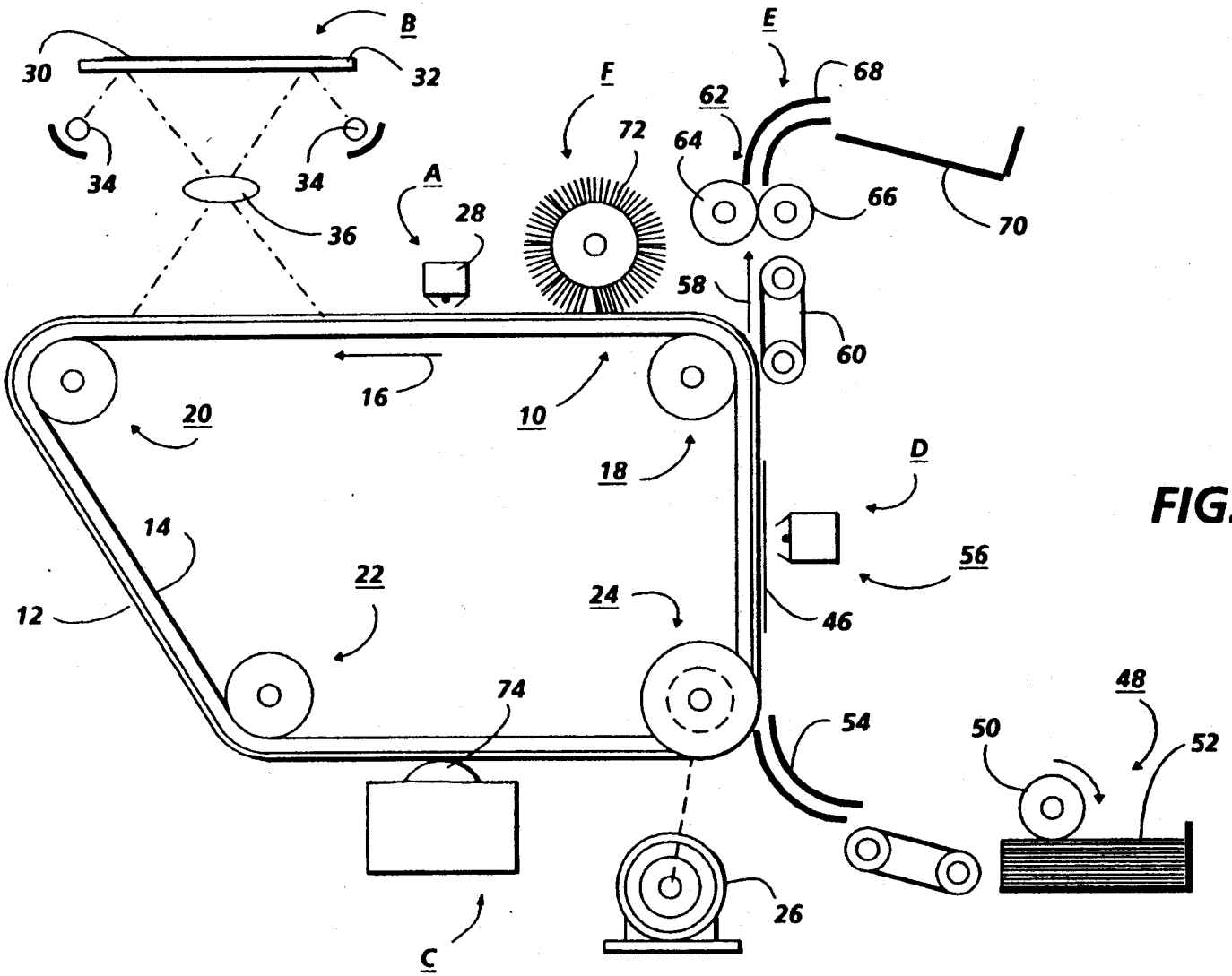
FIG. 1 is a schematic elevational view depicting an electrophotographic printing machine incorporating the development apparatus of the present invention therein.

For a general understanding of the features of the present invention, reference is made to the drawings. In the drawings, like reference numerals have been used throughout to designate identical elements. FIG. 1 schematically depicts the various elements of an illustrative electrophotographic printing machine incorporating the apparatus of the present invention therein. It will become evident from the the following discussion that this apparatus is equally well suited for use in a wide variety of printing machines and is not necessarily limited in its application to the particular embodiments depicted herein.

Inasmuch as the art of electrophotographic printing is well known, the various processing stations employed in the FIG. 1 printing machine will be shown hereinafter schematically and their operation described briefly with reference thereto.

Turning now to FIG. 1, the electrophotographic printing machine employs a belt 10 having a photoconductive surface 12 deposited on a conductive substrate 14. Preferably, photoconductive surface 12 is made from a selenium alloy with conductive substrate 14 being made from an aluminum alloy which is electrically grounded. Other suitable photoconductive surfaces and conductive substrates may also be employed. Belt 10 moves in the direction of arrow 16 to advance successive portions of photoconductive surface 12 through the various processing stations disposed about the path of movement thereof. As shown, belt 10 is entrained about rollers 18, 20, 22 and 24. Roller 24 is coupled to motor 26 which drives roller 24 so as to advance belt 10 in the direction of arrow 16. Rollers 18, 20, and 22 are idler rollers which rotate freely as belt 10 moves in the direction of arrow 16.

Initially, a portion of belt 10 passes through charging station A. At charging station A, a corona generating device, indicated generally by the reference numeral 28, charges a portion of photoconductive surface 12 of belt 10 to a relatively high, substantially uniform potential.

Next, the charged portion of photoconductive surface 12 is advanced through exposure station B. At exposure station B, an original document 30 is positioned face down upon a transparent platen 32. Lamps 34 flash light rays onto original document 30. The light rays reflected from original document 30 are transmitted through lens 36 forming a light image thereof. Lens 36 focuses the light image onto the charged portion of photoconductive surface 12 to selectively dissipate the charge thereon. This records an electrostatic latent image on photoconductive surface 12 which corresponds to the informational areas contained within original document 30 disposed upon transparent platen 32. Thereafter, belt 10 advances the electrostatic latent image recorded on photoconductive surface 12 to development station C.

A development station C, a developer unit, indicated generally by the reference numeral 38, transports a single component developer material of toner particles into contact with the electrostatic latent image recorded on photoconductive surface 12. Toner particles are attracted to the electrostatic latent image forming a toner powder image on photoconductive surface 12 of belt 10 so as to develop the electrostatic latent image. The detailed structure of developer unit 38 will be described hereinafter with reference to FIG. 2.

After development, belt 10 advances the toner powder image to transfer station D. At transfer station D, a sheet of support material 46 is moved into contact with the toner powder image. Support material 46 is advanced to transfer station D by a sheet feeding apparatus, indicated generally by the reference numeral 48. Preferably, sheet feeding apparatus 48 includes a feed roll 50 contacting the upper most sheet of a stack of sheets 52. Feed roll 50 rotates to advance the upper most sheet from stack 50 into chute 54. Chute 54 directs the advancing sheet of support material 46 into contact with photoconductive surface 12 of belt 10 in a timed sequence so that the toner powder image developed thereon contacts the advancing sheet of support material at transfer station D.

Transfer station D includes a corona generating device 56 which sprays ions onto the backside of sheet 46. This attracts the toner powder image from photoconductive surface 12 to sheet 46. After transfer, the sheet continues to move in the direction of arrow 58 onto a conveyor 60 which moves the sheet to fusing station E.

Fusing station E includes a fuser assembly, indicated generally by the reference numeral 62, which permanently affixes the powder image to sheet 46. Preferably, fuser assembly 62 includes a heated fuser roller 64 and a back-up roller 66. Sheet 46 passes between fuser roller 64 and back-up roller 66 with the toner powder image contacting fuser roller 64. In this manner, the toner powder image is permanently affixed to sheet 46. After fusing, chute 68 guides the advancing sheet to catch tray 70 for subsequent removal from the printing machine by the operator.

Invariably, after the sheet of support material is separated from photoconductive surface 12 of belt 10, some residual particles remain adhering thereto. These residual particles are removed from photoconductive surface 12 at cleaning station F. Cleaning station F includes a pre-clean corona generating device (not shown) and a rotatably mounted fibrous brush 72 in contact with photoconductive surface 12. The pre-clean corona generator neutralizes the charge attracting the particles to the photoconductive surface. These particles are cleaned from the photoconductive surface by the rotation of brush 72 in contact therewith. Subsequent to cleaning, a discharge lamp (not shown) floods photoconductive surface 12 with light to dissipate any residual charge remaining thereon prior to the charging thereof for the next successive imaging cycle.

It is believed that the foregoing description is sufficient for purposes of the present application to illustrate the general operation of an exemplary electrophotographic printing machine incorporating the features of the present invention therein.

Referring now to FIG. 2, the detailed structure of developer unit 38 is shown thereat. The developer unit include a donor roller 74. Donor roller 74 may be a bare metal such as aluminum. Alternatively, the donor roller may be a metal roller coated with a thick material. By way of example, a polytetrafluoroethylene based resin such as Teflon, a trademark of the DuPont Corporation, or a polyvinylidene fluoride based resin, such as Kynar, a trademark of the Pennwalt Corporation, may be used to coat the metal roller. This coating acts to assist in charging the particles adhering to the surface thereof. Still another type of donor roller may be made from stainless steel plated by a catalytic nickel generation process and impregnated with Teflon. The surface of the donor roller is roughened from a fraction of a micron to several microns, peak to peak. An electrical bias is applied to the donor roller. The electrical bias applied on the donor roller depends upon the background voltage level of the photoconductive surface, the characteristics of the donor roller, and the spacing between the donor roller and the photoconductive surface. It is thus clear that the electrical bias applied on the donor roller may vary widely. Donor roller 74 is coupled to a motor which rotates donor roller 74 in the direction of arrow 76. Donor roller 74 is positioned, at least partially, in chamber 78 of housing 80. The elongated toner fluidizing member, indicated generally by the reference numeral 44, fluidizes the toner particles. The fluidized toner particles seek their own level under the influence of the gravity. Inasmuch as new toner particles are being discharged from container 86 into one end of the chamber 78 of housing 80, the force exerted on the fluidized toner particles by the new toner particles being added at that end moves the fluidized toner particles from that end of housing 80 to the other end thereof. Elongated member 44 is located in chamber 78 closely adjacent to an arcuate portion 84 of housing 80. Arcuate portion 84 is closely adjacent to elongated member 44 and wraps about a portion thereof. There is a relatively small gap or space between arcuate portion 84 and a portion of elongated member 44. New toner particles are discharged into one end of chamber 78 from container 86. As elongated member 44 rotates in the direction of arrow 40, toner particles are fluidized. A motor (not shown) rotates elongated member 44 at at least 300 revolutions per minute. The force exerted on the fluidized toner particles by the new particles being discharged into chamber 78 advances the fluidized toner particles from the end of the chamber in which the new toner particles have been discharged to the other end thereof. The fluidized toner particles being moved are attracted to donor roller 74. Elongated member 44 is made from an electrically conductive material, such as aluminum, coated with an insulating material, such as a plastic material. Voltage source 42 is electrically connected to elongated member 44. An electrical bias ranging from about 250 volts to about 1000 volts is applied between donor roller 74 and elongated member 44. Preferably, an electrical bias from about 500 volts to about 900 volts is applied between donor roller 74 elongated member 44. Elongated member 44 is spaced from donor roller 74 to define a gap therebetween. This gap may range from about 0.05 centimeters to about 0.15 centimeters . Donor roller 74 rotates in the direction of arrow 76 to move the toner particles attracted thereto into contact with the electrostatic latent image recorded on photoconductive surface 12 of belt 10. As donor roller 74 rotates in the direction of arrow 76, charging blade 82 as the region of the free thereof resiliently urged into contact with donor roller 74. Charging blade 82 may be made from a metal, silicone rubber, or a plastic material. By way of example, charging blade 82 may be made from steel phosphor bronze and ranges from about 0.025 millimeters to about 0.25 millimeters in thickness, being a maximum of 25 millimeters wide. The free end of the charging blade extends beyond the tangential contact point with donor roller 74 by about 4 millimeters or less. Charging blade 82 is maintained in contact with donor roller 74 at a pressure ranging from about 10 grams per centimeter to about 250 grams per centimeter. The toner particles layer adhering to donor roller 74 is charged to a maximum of 60 microcoulombs with the toner mass adhering thereto ranging from about 0.1 milligrams per centimeter$^2$ to about 2 milligrams per centimeter$^2$ of roll surface. It is thus seen that elongated member 44 continually fluidizes these toner particles. These fluidized toner particles are attracted from elongated member 44 to donor roller 74. Donor roller 74 transports these toner particles in the direction of arrow 76. The toner particles adhering to donor roller 74 are charged by charging blade 82 prior to advancing into contact with the electrostatic latent image recorded on photoconductive surface 12. These toner particles are attracted to the electrostatic latent image to form a toner powder image on photoconductive surface 12 of belt 10. The detailed structure of various embodiments of elongated member 44 will be described hereinafter with reference to FIGS. 3*a*, 3*b*, 4*a* and 4*b*.

Turning now to FIGS. 3*a* and 3*b*, there is shown one embodiment of elongated member 44. As depicted thereat, elongated member 44 includes a rod 92 having a cylindrical member 96 mounted thereon. Cylindrical member 96 has a plurality of spaced saw tooth shaped paddles 94 extending outwardly therefrom. As elongated member 44 rotates, the paddles agitate and fluidize the toner particles. The toner particles fly off the tips of the saw tooth shaped paddles so as to be fluidized. The pressure or force exerted on the fluidized toner particles by the new toner particles being discharged from toner container 86 (FIG. 2) moves the fluidized toner particles from one end of the chamber 78 (FIG. 2) of housing 80 (FIG. 2) to the other end thereof.

Turning now to FIGS. 4*a* and 4*b*), there is shown another embodiment of an elongated member 44. As depicted thereat, elongated member 44 includes a hollow rod or tube 104 having four equally spaced rows of apertures or holes 106 therein. Each row of holes is spaced about the periphery of rod 104 by about 90° C. Each hole in each row is spaced from the next adjacent hole. The holes are equally spaced from one another. In this way, as tube 104 rotates, the toner particles travel through the center of the tube and out through the various holes so as to be fluidized. In this embodiment, as in all other embodiments described herein, the fluidized toner particles are advanced from one end of the chamber of the developer housing to the other end thereof by the back pressure exerted by the head of fresh or new toner particles being discharged into the chamber from the toner storage container.

In recapitulation, it is clear that the apparatus of the present invention includes a rotating elongated member disposed in the chamber of the developer housing for fluidizing the toner particles therein. A toner storage container discharges new toner particles into the chamber. The pressure exerted open the fluidizied toner particles by the new toner particles being discharged into the chamber moves the fluidized toner particles from one end of the chamber to the other end thereof. An electrical bias is applied between a donor roller and the elongated member. Fluidized toner particles are attracted to the donor member. The donor member transports the fluidized toner particles closely adjacent to the photoconductive belt so as to develop the electrostatic latent image recorded thereon.

It is, therefore, evident that there has been provided, in accordance with the present invention a particle transport that fully satisfies the aims and advantages hereinbefore set forth. While this invention has been described in conjunction with various embodiments thereof, it is evident that many alternatives, modifications and variations will be apparent to those skilled in the art. Accordingly, it is intended to embrace all such alternatives, modifications and variations as fall within the spirit and broad scope of the appended claims.

We claim:

1. An electrophotographic printing machine of the type having an electrostatic latent image recorded on a photoconductive member; wherein the improvement includes:

a housing defining a chamber storing a supply of developer material therein, said housing comprises an arcuate portion;

a roller, disposed at least partially in the chamber of said housing and mounted rotatably therein, for transporting developer material into contact with the latent image recorded on the photoconductive member;

a blade having the free end region thereof resiliently urged into engagement with said roller, said blade electrically charging the developer material being advanced into contact with the latent image by said roller and metering the quantity of developer material being advanced by said roller to the latent image;

means, disposed in the chamber of said housing, for fluidizing the developer material, said fluidizing means comprises a rotatably mounted elongated member disposed interiorly of the chamber of said housing in the region of and closely adjacent to the arcuate portion of said housing, said elongated member being made from an electrically conductive material having an insulating coating thereon, said elongated member includes a cylindrical body having a plurality of saw tooth shaped paddles extending radially outwardly therefrom;

means for discharging additional developer material into the chamber of said housing with the developer material being discharged into the chamber exerting a pressure on the fluidized developer material to move the fluidized developer material from one end of said housing to the other end thereof; and means for applying an electrical bias between said elongated member and said roller so that fluidized developer material is attracted to said roller.

2. An electrophotographic printing machine of the type having an electrostatic latent image recorded on a photoconductive member, wherein the improvement includes:

a housing defining a chamber storing a supply of developer material therein, said housing comprises an arcuate portion;

a roller, disposed at least partially in the chamber of said housing and mounted rotatably therein, for transporting developer material into contact with the latent image recorded on the photoconductive member;

means, disposed in the chamber of said housing, for fluidizing the developer material, said fluidizing means comprises a rotatably mounted elongated member disposed interiorly of the chamber of said housing in the region of and closely adjacent to the arcuate portion of said housing, said elongated member being made from an electrically conductive material having an insulating coating thereon;

means for electrically charging the developer material being advanced into contact with the latent image by said roller, said charging means meters the quantity of developer material being advanced by said roller to the latent image, said charging means includes a blade having the free end region thereof resiliently urged into engagement with said roller;

means for discharging additional developer material into the chamber of said housing with the developer material being discharged into the chamber exerting a pressure on the fluidized developer material to move the fluidized developer material from one end of said housing to the other end thereof; and means for applying an electrical bias between said elongated member and said roller so that fluidized developer material is attracted to said roller, said applying means includes a voltage source electrically coupled to said elongated member to apply an electrical bias between said elongated member and said roller, said voltage source applies an electrical bias arranging from about 250 volts to about 1000 volts between said elongated member and said roller.

3. A printing machine according to claim 2, wherein said voltage source applies an electrical bias preferably ranging from about 500 volts to about 900 volts between said elongated member and said roller.

4. An electrophotographic printing machine of the type having an electrostatic latent image recorded on a photoconductive member, wherein the improvement includes:

a housing defining a chamber storing a supply of developer material therein, said housing comprises an arcuate portion;

a roller, disposed at least partially in the chamber of said housing and mounted rotatably therein, for transporting developer material into contact with the latent image recorded on the photoconductive member;

means for electrically charging the developer material being advanced into contact with the latent image by said roller, said charging means meters the quantity of developer material being advanced by said roller to the latent image, said charging means includes a blade having the free end region thereof resiliently urged into engagement with said roller;

means, disposed in the chamber of said housing, for fluidizing the developer material, said fluidizing means comprises a rotatably mounted elongated member disposed interiorly of the chamber of said housing in the region of and closely spaced to the arcuate portion of said housing, said elongated member being made from an electrically conductive material having an insulating coating thereon, said elongated member is spaced from said roller a distance ranging from about 0.05 centimeters to about 0.15 centimeters;

means for discharging additional developer material into the chamber of said housing with the developer material being discharged into the chamber exerting a pressure on the fluidized developer material to move the fluidized developer material from one end of said housing to the other end thereof; and means for applying an electrical bias between said elongated member and said roller so that fluidized developer material is attracted to said roller.

* * * * *